US010590773B2

(12) United States Patent
Brettschneider et al.

(10) Patent No.: US 10,590,773 B2
(45) Date of Patent: Mar. 17, 2020

(54) CONTOURING A BLADE/VANE CASCADE STAGE

(71) Applicant: MTU Aero Engines AG, Munich (DE)

(72) Inventors: Markus Brettschneider, Karlsfeld (DE); Inga Mahle, Munich (DE)

(73) Assignee: MTU Aero Engines AG, Munich (DE)

( * ) Notice: Subject to any disclaimer, the term of this patent is extended or adjusted under 35 U.S.C. 154(b) by 0 days.

(21) Appl. No.: 15/886,977

(22) Filed: Feb. 2, 2018

(65) Prior Publication Data

US 2018/0223670 A1 Aug. 9, 2018

(30) Foreign Application Priority Data

Feb. 6, 2017 (EP) ..... 17154853

(51) Int. Cl.

| | |
|---|---|
| ***F01D 5/14*** | (2006.01) |
| ***F01D 9/04*** | (2006.01) |
| ***F04D 29/32*** | (2006.01) |
| ***F04D 29/54*** | (2006.01) |
| ***F04D 29/66*** | (2006.01) |

(52) U.S. Cl.

CPC ..... *F01D 5/145* (2013.01); *F01D 5/143* (2013.01); *F01D 9/041* (2013.01); *F04D 29/321* (2013.01); *F04D 29/542* (2013.01); *F04D 29/667* (2013.01); *F05D 2240/12* (2013.01); *F05D 2240/123* (2013.01); *F05D 2240/124* (2013.01); *F05D 2240/129* (2013.01); *F05D 2240/80* (2013.01)

(58) Field of Classification Search

CPC ..... F04D 29/667; F05D 2240/12; F05D 2240/123; F05D 2240/124; F05D 2240/129; F05D 2240/80

USPC ..... 416/243

See application file for complete search history.

(56) References Cited

U.S. PATENT DOCUMENTS

| | | | | |
|---|---|---|---|---|
| 7,220,100 | B2 | 5/2007 | Lee et al. | |
| 8,727,716 | B2 | 5/2014 | Clements et al. | |
| 9,376,927 | B2 * | 6/2016 | Stein | F01D 9/041 |
| 2006/0233641 | A1 | 10/2006 | Lee et al. | |
| 2008/0232968 | A1 | 9/2008 | Nguyen | |

(Continued)

FOREIGN PATENT DOCUMENTS

| | | | |
|---|---|---|---|
| EP | 2487329 | B1 | 11/2013 |
| EP | 2787172 | A2 | 10/2014 |

(Continued)

*Primary Examiner* — Eldon T Brockman

(74) *Attorney, Agent, or Firm* — Barlow, Josephs & Holmes, Ltd.

(57) ABSTRACT

Disclosed is a blade/vane cascade segment of a blade/vane cascade of a turbomachine, which comprises at least two blade/vane elements defining an axial cascade width, and a stage with a stage surface, as well as a stage edge on the inflow side. The stage surface has an elevation extending up to the pressure side of a first blade/vane element and a depression extending up to the suction side of the other blade/vane. At least one highest point of the elevation and at least one lowest point of the depression each lie at least 30% and at most 60% of the axial cascade width downstream of the inflow edges of the blade/vane elements. In this case, the elevation and the depression each come close to the stage edge on the inflow side.

13 Claims, 1 Drawing Sheet

(56) References Cited

U.S. PATENT DOCUMENTS

Figure 1:
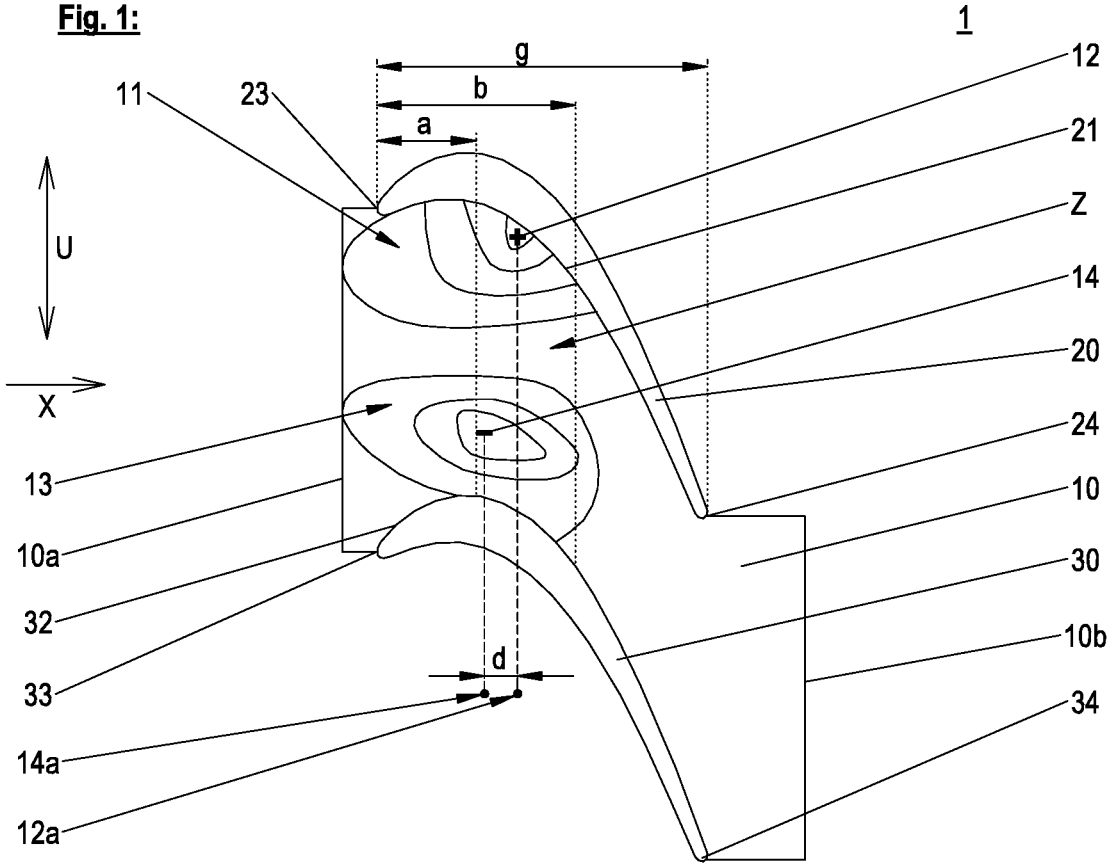

| | | | | |
|---|---|---|---|---|
| 2010/0158696 | A1* | 6/2010 | Pandey | F01D 5/143<br>416/243 |
| 2012/0051900 | A1 | 3/2012 | Clements et al. | |
| 2013/0136621 | A1* | 5/2013 | Wunderer | F01D 5/145<br>416/243 |
| 2014/0169977 | A1* | 6/2014 | Brettschneider | F01D 5/143<br>416/223 A |
| 2017/0159443 | A1* | 6/2017 | Pernleitner | F01D 5/02 |
| 2017/0370234 | A1* | 12/2017 | Brettschneider | F01D 5/30 |

FOREIGN PATENT DOCUMENTS

| | | | |
|---|---|---|---|
| EP | 2696029 | B1 | 10/2015 |
| NO | 20130204 | A1 | 8/2013 |
| WO | 2015195112 | A1 | 12/2015 |

* cited by examiner

CONTOURING A BLADE/VANE CASCADE STAGE

BACKGROUND OF THE INVENTION

The present invention relates to a blade/vane cascade segment, a blade/vane cascade, a stage and a blade/vane channel of a turbomachine, as well as a turbomachine.

Turbomachines (such as gas and steam turbines) generally have a flow channel for conducting a fluid. The flow channel, which is also called an "annular space" is bounded radially inside by the shaft of a rotor and radially outside by a housing; the designations "radially" as well as "axially" and "peripheral direction", and terms derived therefrom in this document are always understood to be with reference to an axis of rotation of the rotor—as long as nothing is indicated to the contrary.

Blade/vane cascades (for which the name "blade/vane ring" is also common) are arranged in the annular space of a turbomachine. They each comprise guide vanes or rotating blades that lie one behind the other in the peripheral direction at essentially regular distances, as well as stages belonging thereto, which are also called "cover plates", and that have a stage edge on the inflow side and a stage edge on the outflow side. These stage edges bound the stage surface facing the blades/vanes (or blade/vane elements) in the axial direction.

In this document, the stage edge "on the inflow side" is designated as the edge of the stage, by which the leading (axial) principal flow first passes into the annular space of the turbomachine during operation; correspondingly, the stage edge "on the outflow side" is the other edge. The indications "downstream" or "upstream", respectively, refer correspondingly to the axial principal flow direction, and thus only to the axial position, regardless of a possible displacement in the peripheral direction: In this document, in particular, a point given as lying "downstream of the inflow edges" (or downstream of another point) is to be understood if the point is arranged offset axially in/with the principal flow direction (thus following it), in comparison to a direct connection of the inflow edges to the surface of the stage (or in comparison to another point); this is valid analogously for the designation "upstream" (with the opposite direction).

The distance of the inflow edges of the blade/vane elements from their outflow edges, which is measured in the direction of the provided axial principal flow is named the "cascade width".

The pressure side of a blade/vane and the suction side of an adjacent blade/vane each bound a so-called blade/vane channel in the peripheral direction. In the radial direction, this blade/vane channel is bounded by so-called side walls within the turbomachine. These side walls are formed, on the one hand, by the stages, and, on the other hand, by sections lying radially opposite to these stages: In the case of rotating blades, such a side wall in this case is a section that lies radially outside (in particular, a section of the housing); in the case of guide vanes, it is a radially inner-lying section (in particular, a rotor hub).

A fluid flow guided through a flow channel is periodically influenced by the surfaces of the side walls. Flow layers that run next to these surfaces are more strongly diverted here, due to their slower speed, than flow layers that are further away from the side walls. Thus, a secondary flow that is superimposed on an axial principal flow arises and, in particular, leads to vortexes and pressure losses.

In order to reduce secondary flows, contouring is frequently introduced in the side walls in the form of elevations and/or depressions A plurality of these types of so-called "side wall contouring" is known from the prior art.

By way of example, the patents or patent applications of the Applicant will be named: EP 2 487 329 B1; EP 2 787 172 A2; and EP 2 696 029 B1. The last-named publication discloses therein a blade/vane cascade with a side wall contouring that has a pressure-side elevation and a suction-side depression, wherein a highest section of the elevation and a lowest section of the depression lie in a region from 30% to 60% of the extension of the blade/vane elements in the axial direction and differ from one another by a maximum 10% in the axial direction.

The publication US 2012/051 900 A1 discloses a guide vane cascade with a side wall contouring, in which a stage surface has an elevation and a depression between the pressure side of one of the vane elements and the suction side of another of the vane elements, and together these form an axially extending arcuate channel.

A blade/vane cascade with a stage is known from US 2006/233 641 A1, the surface of which has elevations increasing in height from the inflow and outflow edges of the blade/vane elements.

SUMMARY OF THE INVENTION

The object of the present invention is to provide a technique with which secondary flows in the annular space of a turbomachine can be further reduced in an advantageous way.

The object is achieved by a blade/vane cascade segment, a blade/vane cascade, a blade/vane channel, a stage, and a turbomachine according to the present invention. Advantageous embodiments are disclosed in the dependent claims, the description and the figures.

A blade/vane cascade segment according to the invention for a blade/vane cascade (e.g., a rotating blade cascade or a guide vane cascade) of a turbomachine comprises at least two blade/vane elements (preferably adjacent in the blade/vane cascade) and a stage. The blade/vane elements each have an inflow edge and an outflow edge, by which an axial cascade width is defined. The stage (which can form a part of a radially inner or a radially outer side wall of a blade/vane channel) has a stage edge on the inflow side as well as a stage surface. The latter has at least one elevation extending up to the pressure side of a first blade/vane element, and at least one depression extending up to the suction side of another (thus the second) blade/vane element. At least one highest point of the at least one elevation and at least one lowest point of the at least one depression each lie at least 30% and at most 60% of the axial cascade width downstream of the inflow edges of the blade/vane elements. In this way, the at least one elevation and the at least one depression each come close to the stage edge on the inflow side.

In particular, a blade/vane cascade segment according to the invention may have one or more elevation(s) or one or more depression(s), each of which has properties that are named above and/or in the following. The phrase "at least one" for the elevation and for the depression is omitted in the following for reasons of better readability.

In this document, an "elevation" is understood to be a local formation (such as, for example, a bulge or projection) in the stage surface, in which the latter extends to the side facing the blade/vane elements. A "depression" is analogously understood to be a local formation in the stage surface in the other direction (thus, to the side facing away from the blade/vane elements (such as, e.g., a valley or an indentation).

The designations "elevation" and "depression" (just like terms such as "lowered" or the like) are thus here based on an orientation or coordinate system, in which the blade/vane elements and an elevation extend toward the "top" from the stage surface, and a depression correspondingly leads in the opposite direction (toward the "bottom").

The highest and lowest points are each to be understood as the points of the elevation or depression, in which the elevation or the depression extends the furthest in the respective direction. The highest and lowest points, respectively, can each form a surface area section or a curve or can be a single point. According to an exemplary embodiment, the elevation has precisely one highest point and/or the depression has precisely one lowest point.

In particular, the stage surface may comprise a surface section (e.g., not contoured), which extends preferably up to the stage edge on the outflow side (or comprises it) and which determines a null surface in the sense that an elevation lies radially above the null surface and a depression lies radially below it. In the peripheral direction, the named surface section preferably has essentially the same curvature as the stage edge on the outflow side; in particular, it can be planar if the stage edge on the outflow side is straight.

The stage edge on the inflow side is preferably set up for the purpose of being used in the turbomachine (at least essentially) adjacent to another (separate) element (e.g., the hub or the housing or another blade/vane cascade). It can be set up for the purpose of forming a section of a wall of a gap through which cooling fluid will be introduced or will be able to be introduced into the annular space of the turbomachine. In the peripheral direction, the stage edge on the inflow side (which can comprise sections of several parts of a multipart stage is preferably delimited by the (peripheral direction) positions of the inflow edges of the two blade/vane elements; these boundaries can have a physical shaping (e.g., in that the stage terminates in them in the peripheral direction) or can be established or will be established only abstractly for defining the stage edge on the inflow side.

In the peripheral direction, the at least one elevation and the at least one depression transition into each other, at least in one region of the stage surface, and there they are thus separated only by a curve (which lies on the stage surface and thus describes a zero contour line); the surroundings of the curve can be described mathematically as a graph of a total differentiable function; thus its directional derivatives in the peripheral direction differ from zero at all points of the curve. The curve can extend out from the stage edge on the inflow side, thus can come close to the latter. In the axial direction, the curve preferably has an extent of at least 20%, at least 30%, or in fact at least 50%, of the axial cascade width.

Alternatively, or additionally, at least in one section of the stage surface, the at least one elevation and the at least one depression can be separated by a non-contoured surface portion of the stage surface, which separates the elevation and the depression from one another in the section in the peripheral direction (and thus describes a null surface).

A blade/vane cascade segment according to the invention can be made of one part or it can be a composite. In particular, the stage can be made of one part or can comprise two or more parts, from each of which projects one of the blade/vane elements, or the stage can be formed as a separate component that is arranged or can be arranged between the blade/vane elements. Correspondingly, a stage according to the invention is set up for the purpose of bounding a blade/vane element on each side in the peripheral direction and to form together with the blade/vane elements (none, one, or both of which can be rigidly molded to the stage) a blade/vane cascade segment according to the invention in accordance with one of the embodiments disclosed in this document.

A blade/vane cascade according to the invention comprises at least one blade/vane cascade segment according to the invention in accordance with one of the embodiments disclosed in this document. A turbomachine according to the invention comprises one or more blade/vane cascade(s) according to the invention.

A blade/vane channel according to the invention passes through a blade/vane cascade segment according to the invention in accordance with one of the embodiments disclosed in this document; i.e., it is bounded by such a blade/vane cascade segment and a side wall lying opposite to the stage thereof (facing the surface of the stage). In particular, the blade/vane channel is bounded in the peripheral direction by the pressure side of one of the blade/vane elements of the blade/vane cascade segment and by the suction side of the (adjacent) other blade/vane element lying opposite thereto.

Due to the geometry of the stage surface according to the invention, a blade/vane cascade segment according to the invention, a blade/vane cascade according to the invention, a blade/vane channel according to the invention, a stage according to the invention, and a turbomachine according to the invention will influence the static pressure field at the surface of the stage and affect the blades/vanes in the edge region. In this way, a reduction of the secondary flow is made possible in each case, in particular by vortexes in the blade/vane channel. Thus, losses can be reduced and the flow into a blade/vane cascade lying further downstream can be improved as needed.

The blade/vane cascade segment or the blade/vane cascade or the flow channel or the stage can be incorporated or utilized in a low-pressure turbine or, in particular, in part of a low-pressure turbine, or can be set up for this purpose. The blade/vane elements can be guide vane elements or rotating blade elements in each case. The stage can be set up so that the blade/vane cascade segment bounds a blade/vane channel radially inwardly or radially outwardly.

The first blade/vane element can rest on the elevation, in particular at least partially, and/or the second blade/vane element can rest at least partially in the depression.

Advantageously, there is a variant of embodiment in which the at least one highest point of the elevation lies on a boundary line between the first blade/vane element (or the pressure side thereof) and the surface of the stage. In the surroundings of such a highest point, the surface of the stage can be shaped either convex or concave.

Analogously, the lowest point of the depression (if necessary, in addition) can lie on a boundary line between the second blade/vane element (or the suction side thereof) and the surface of the stage. In the surroundings of such a lowest point, the surface of the stage can be shaped either convex or concave.

An embodiment of the present invention has been demonstrated to be advantageous, in which the respective axial positions of the at least one highest point of the elevation and of the at least one lowest point of the depression differ from one another by at most 10% of the axial cascade width. The highest and lowest points in this case thus lie in a surface strip of the stage between the blade/vane elements, the boundaries on the inflow and outflow sides thereof run in the peripheral direction, and the strip has a width of 10% of the cascade width in the axial direction. According to an advantageous enhancement, such a surface strip is intersected in the axial direction by a curve, in which the at least one elevation and the at least one depression transition into one another, as described above.

In an advantageous enhancement of the present invention, the at least one highest point of the elevation is disposed downstream of the at least one lowest point of the depression.

The stage edge on the inflow side can cover the at least one elevation and/or the at least one depression. The elevation or the depression can thus run into the stage edge on the inflow side, so that this edge itself (considered as a one-dimensional curve) has a contour, preferably runs in a curved manner. In particular, the stage edge on the inflow side can have a maximum (a hill) in the region of the elevation (or of a tail of the elevation) and/or a minimum (a valley) in the region of the depression (or of a tail of the depression); the designations "maximum" and "minimum" in this case are to be understood as analogous to the terms "elevation" or "depression".

According to an advantageous embodiment of the present invention, beyond the named at least one elevation, the stage surface has at least one additional elevation that extends to the suction side of the other (second) blade/vane element. Preferably, the additional elevation is disposed upstream of the at least one depression. A highest point of the at least one additional elevation lies most preferably at most 15% or even at most 10% of the axial cascade width downstream of the inflow edges of the blade/vane elements.

Analogously to the at least one elevation (see above), the additional elevation in the peripheral direction can transition into the at least one depression, at least in one region of the stage surface, thus can be separated there only by a line (lying on the stage surface) (which then thus describes a zero contour line); the surroundings of the curve can be described mathematically as a graph of a total differentiable function; thus its directional derivatives in the peripheral direction differ from zero at all points of the line. According to an advantageous embodiment, the additional elevation is separated completely from the at least one depression in the peripheral direction by such a line. The line can extend from the stage edge on the inflow side, and/or at least one of the ends or both ends of the line can come close to the suction side of the second blade/vane element.

The second blade/vane element can rest partially on the additional elevation. An embodiment has been demonstrated to be advantageous, in which the additional elevation has its highest point(s) on a boundary line between the second blade/vane element (or the suction side thereof) and the stage surface. In the surroundings of this point or these points, the stage surface can be shaped convex or concave.

BRIEF DESCRIPTION OF THE DRAWING FIGURES

Preferred embodiment examples of the invention will be explained in more detail in the following based on drawings. It is understood that individual elements and components can also be combined in other ways than what is shown. Reference numbers for elements corresponding to one another are used in all of the figures and are not newly described for each figure.

Figure 2:
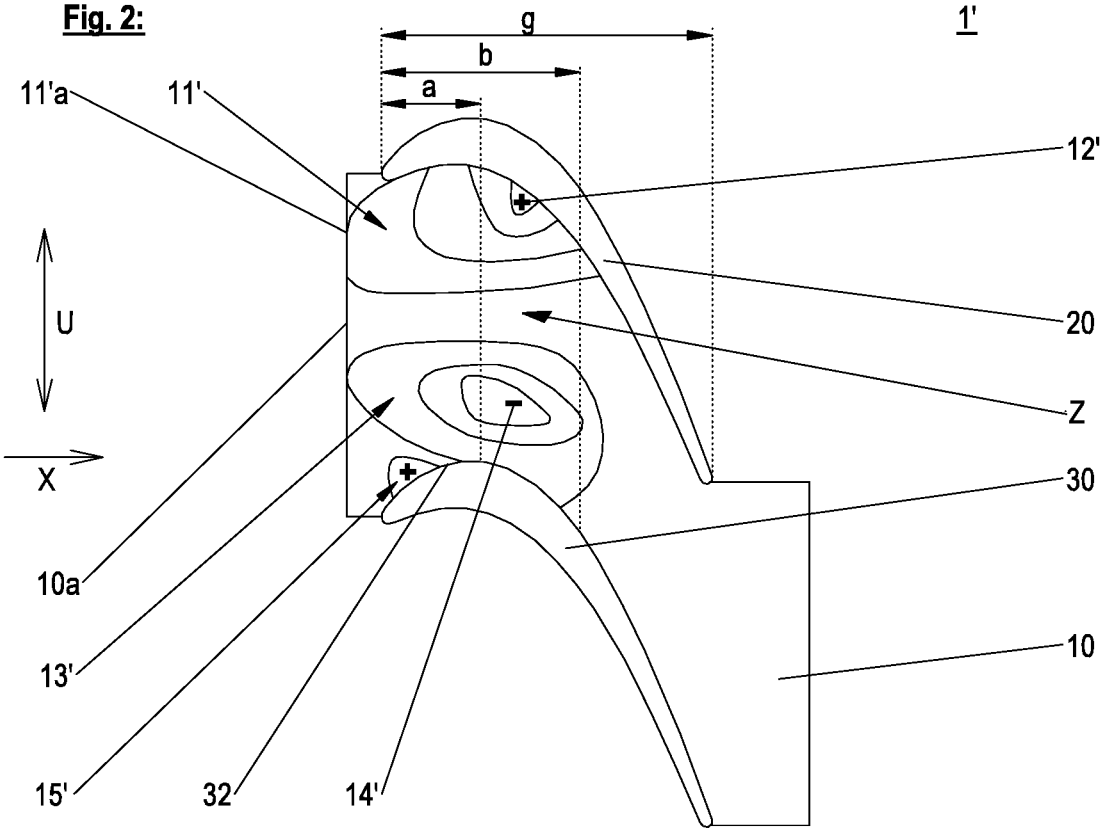

Herein, shown schematically:

FIG. 1 shows a blade/vane cascade segment of an exemplary embodiment of the present invention in top view; and FIG. 2 shows a blade/vane cascade segment of an alternative exemplary embodiment of the present invention in top view.

DESCRIPTION OF THE INVENTION

An exemplary, developed embodiment of a blade/vane cascade segment 1 according to the invention is shown schematically in FIG. 1 in top view (with radial direction of view). It comprises blade/vane elements 20, 30, each of which has a pressure side and a suction side, as well as a stage 10 according to the invention, with a stage edge 10*a* on the inflow side and a stage edge 10*b* on the outflow side (relative to the provided principal flow direction X). The stage can be designed in one part, or, for example, can be made of two parts (not shown); in particular, it can comprise two parts, and one of the blade/vane elements 20, 30 projects from each part.

The blade/vane elements 20, 30 define an axial cascade width g by the distance between their inflow edges 23, 33 and their outflow edges 24, 34 at the stage surface, this width being measured in the axial principal flow direction X.

The stage surface has an elevation 11 with a highest point 12 illustrated by contour lines in FIG. 1, extending up to the pressure side 21 of the one (first) blade/vane element 20. As can be seen from the contour lines, the blade/vane element 20 rests partially (namely in its front region) on the elevation 11.

Furthermore, the stage surface has a depression 13 with a lowest point 14, again illustrated by contour lines in FIG. 1, extending up to the suction side 32 of the other (second) blade/vane element 30. Again, as can be seen from the contour lines, the blade/vane element 30 rests partially (namely in its front region) in the depression 13.

In this case, the highest point 12 and the lowest point 14 lie in an intermediate strip Z of the stage surface. In the top view that is shown (thus actually in the projection in the radial direction onto the stage surface), the boundaries of the intermediate strip Z on the inflow side and on the outflow side each run parallel to the stage edge 10*a* on the inflow side. The boundary of the intermediate strip on the inflow side lies by a distance a and the boundary on the outflow side lies by a distance b downstream of the inflow edges 23, 33, of the blade/vane elements 20, 30; in this case, the following applies: a=0.3 g and b=0.6 g. All points in the intermediate strip Z (and, in particular, the highest point 12 of the elevation and the lowest point 14 of the depression) thus lie at least 30% and at most 60% of the axial cascade width downstream of the inflow edges of the blade/vane elements.

As is characterized by the contour lines in the figure, both the elevation 11 as well as the depression 13 extend up to the stage edge 10*a* on the inflow side.

The highest point 12 of the elevation 11 has an axial position 12*a*, and the lowest point 14 of the depression analogously has an axial position 14*a*. In the axial direction, these positions 12*a*, 14*a*, have a distance d from one another; according to an advantageous embodiment, $d \leq 0.1$ g applies, so that the named axial positions thus differ from one another by at most 10% of the axial cascade width g in the axial direction.

FIG. 2 shows an alternative embodiment of a developed blade/vane cascade segment 1' according to the invention in top view (with radial direction of view). Like the blade/vane cascade segment 1 shown in FIG. 1, it comprises blade/vane elements 20, 30 and a stage 10 according to the invention with a stage surface and a stage edge 10*a* on the inflow side and a stage edge 10*b* on the outflow side (relative to the provided axial principal flow direction X).

Like the blade/vane cascade segment 1 shown in FIG. 1, the stage surface of the blade/vane cascade segment 1' shown in FIG. 2 also has an elevation 11' with a highest point 12' extending up to the pressure side 21 of the one (first) blade/vane element 20 and a depression 13' with a lowest point 14' extending up to the suction side 32 of the other (second) blade/vane element 30. The highest point 12' of the elevation and the lowest point 14' of the depression both lie in the intermediate strip Z, which is defined by the distances a, b as described above; thus, each are arranged at least 30% and at most 60% of the axial cascade width g downstream of the inflow edges 23, 33 of the blade/vane elements 20, 30.

In the exemplary embodiment shown in FIG. 2, the stage edge 10*a* on the inflow side covers the elevation 11' in a section 11'*a*. The stage edge 10*a* on the inflow side thus also has a contour (not shown in FIG. 2), in which it has a local maximum in the region 11'*a* (as a graph of a one-dimensional function).

The blade/vane cascade segment 1' also has another elevation 15', which extends up to the suction side 32 of the second blade/vane element 30. In this case, the additional elevation 15' is arranged upstream of the depression 13'.

Disclosed is a blade/vane cascade segment 1, 1' of a blade/vane cascade of a turbomachine, which comprises at least two blade/vane elements 20, 30 defining an axial cascade width g, and a stage 10 with a stage surface as well as a stage edge 10*a* on the inflow side. The stage surface has an elevation 11, 11' extending up to the pressure side 21 of a first blade/vane element 20 and a depression 13, 13' extending up to the suction side 32 of the other blade/vane element 30. At least one highest point 12, 12' of the elevation 11, 11' and at least one lowest point 14, 14' of the depression 13, 13' each lie at least 30% and at most 60% of the axial cascade width g downstream of the inflow edges 23, 33 of the blade/vane elements 20, 30. In this case, the elevation 11, 11' and the depression 13, 13' each come close to the stage edge 10*a* on the inflow side.

Also disclosed are a blade/vane cascade, a stage for a blade/vane cascade segment, a blade/vane channel bound in the peripheral direction U, and a turbomachine.

It would be appreciated by those skilled in the art that various changes and modifications can be made to the illustrated embodiments without departing from the spirit of the present invention. All such modifications and changes are intended to be covered by the appended claims.

What is claimed is:

1. A blade/vane cascade segment of a blade/vane cascade of a turbomachine, comprising:

at least two blade/vane elements, each defining an axial cascade width by their inflow and outflow edges;

a stage having a stage surface and a stage edge, the stage edge being the leading edge on the inflow side;

wherein the stage surface has an elevation extending up to the pressure side of a first blade/vane element and a depression extending up to the suction side of the other blade/vane element;

wherein at least one highest point of the elevation and at least one lowest point of the depression each lie at least 30% and at most 60% of the axial cascade width downstream of the inflow edges of the blade/vane elements; and wherein the elevation and the depression each extend directly from the stage edge on the inflow side.

2. The blade/vane cascade segment according to claim 1, wherein axial positions of the at least one highest point of the elevation and of the at least one lowest point of the depression differ from one another by at most 10% of the axial cascade width.

3. The blade/vane cascade segment according to claim 1, wherein the at least one highest point of the elevation is arranged downstream of the at least one lowest point of the depression.

4. The blade/vane cascade segment according to claim 1, wherein the stage edge on the inflow side covers the elevation and/or the depression.

5. The blade/vane cascade segment according to claim 1, wherein the stage surface also has an additional elevation, which extends up to the suction side of the other blade/vane element.

6. The blade/vane cascade segment according to claim 5, wherein the additional elevation is arranged upstream of the depression.

7. The blade/vane cascade segment according to claim 5, wherein a highest point of the additional elevation lies at most 15% or even at most 10% of the axial cascade width downstream of the inflow edges of the blade/vane elements.

8. The blade/vane cascade segment according to claim 5, wherein the additional elevation has at least one highest point that lies on a boundary line of the stage surface to the suction side of the other blade/vane element.

9. The blade/vane cascade segment according to claim 1, wherein the blade/vane cascade is a guide vane cascade or a rotating blade cascade.

10. The blade/vane cascade segment according to claim 1, wherein the blade/vane cascade segment is used in a blade/vane cascade in a turbomachine.

11. The blade/vane cascade segment according to claim 1, wherein the blade/vane cascade segment and a side wall lying opposite to the stage of the blade/vane cascade segment bounds a channel of a turbomachine.

12. The blade/vane cascade segment according to claim 1, wherein a stage bounds the at least two blade/vane elements in a peripheral direction.

13. The blade/vane cascade segment according to claim 1, where at least one blade/vane cascade is used in a turbomachine.

* * * * *